US009664386B2

(12) United States Patent
Krichtafovitch

(10) Patent No.: US 9,664,386 B2
(45) Date of Patent: May 30, 2017

(54) DYNAMIC FLAME CONTROL

(71) Applicant: ClearSign Combustion Corporation, Seattle, WA (US)

(72) Inventor: Igor A. Krichtafovitch, Kirkland, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 518 days.

(21) Appl. No.: 14/195,032

(22) Filed: Mar. 3, 2014

(65) Prior Publication Data

US 2014/0255855 A1 Sep. 11, 2014

Related U.S. Application Data

(60) Provisional application No. 61/773,093, filed on Mar. 5, 2013.

(51) Int. Cl.

| | |
|---|---|
| ***F23N 5/00*** | (2006.01) |
| ***F23N 5/12*** | (2006.01) |
| ***F23C 99/00*** | (2006.01) |
| ***F23D 11/40*** | (2006.01) |
| ***F23D 14/84*** | (2006.01) |

(52) U.S. Cl.

CPC ..... *F23N 5/00* (2013.01); *F23C 99/001* (2013.01); *F23D 11/406* (2013.01); *F23D 14/84* (2013.01); *F23N 5/123* (2013.01)

(58) Field of Classification Search

CPC ..... F23D 14/84; F23D 11/406; F23N 5/265; F23N 5/00; F23N 5/12; F23N 5/123; F23C 99/001; F23C 5/14; H01T 23/00

See application file for complete search history.

(56) References Cited

U.S. PATENT DOCUMENTS 3,822,981 A * 7/1974 Walbridge ..... F23N 5/12 431/78

4,111,636 A 9/1978 Goldberg (Continued)

FOREIGN PATENT DOCUMENTS

| | | |
|---|---|---|
| EP | 1139020 | 8/2006 |
| EP | 2738460 | 6/2014 |

(Continued)

*Primary Examiner* — Alfred Basichas

(74) *Attorney, Agent, or Firm* — Dorsey & Whitney LLP

(57) ABSTRACT

In an embodiment, a combustion system includes a burner, a flame charging device, and a flame control system. The burner outputs a flow including fuel that when ignited generates a flame. The flame charging device is positioned adjacent to the flame and charges the flame to generate a charged flame. The control system includes one or more electrodes disposed adjacent to the charged flame, a charge managing module operatively coupled to the one or more electrodes, one or more sensors in electrical communication to the controller, and a controller in electrical communication with the charge managing module and the one or more sensors. The charge managing module controls charging and discharging of the electrodes. The sensors are positioned and configured to measure at least one combustion parameter of the charged flame. The controller controls operation of the charge managing module responsive to the at least one combustion parameter measured by the sensors.

5 Claims, 5 Drawing Sheets

(56) References Cited

U.S. PATENT DOCUMENTS

| | | | |
|---|---|---|---|
| 5,784,889 | A | 7/1998 | Joos et al. |
| 8,911,699 | B2 | 12/2014 | Colannino et al. |
| 9,151,549 | B2 | 10/2015 | Goodson et al. |
| 9,243,800 | B2 | 1/2016 | Goodson et al. |
| 9,267,680 | B2 | 2/2016 | Goodson et al. |
| 9,284,886 | B2 | 3/2016 | Breidenthal et al. |
| 9,289,780 | B2 | 3/2016 | Goodson |
| 9,310,077 | B2 | 4/2016 | Breidenthal et al. |
| 9,366,427 | B2 | 6/2016 | Sonnichsen et al. |
| 9,371,994 | B2 | 6/2016 | Goodson et al. |
| 9,377,188 | B2 | 6/2016 | Ruiz et al. |
| 9,377,189 | B2 | 6/2016 | Ruiz et al. |
| 9,377,195 | B2 | 6/2016 | Goodson et al. |
| 9,388,981 | B2 | 7/2016 | Karkow et al. |
| 2006/0165555 | A1 | 7/2006 | Spielman et al. |
| 2011/0027734 | A1 | 2/2011 | Hartwick et al. |
| 2012/0276487 | A1 | 11/2012 | Hangauer et al. |
| 2012/0317985 | A1 | 12/2012 | Hartwick et al. |
| 2013/0071794 | A1 | 3/2013 | Colannino et al. |
| 2013/0170090 | A1 | 7/2013 | Colannino et al. |
| 2013/0230810 | A1 | 9/2013 | Goodson et al. |
| 2013/0260321 | A1 | 10/2013 | Colannino et al. |
| 2013/0323655 | A1 | 12/2013 | Krichtafovitch et al. |
| 2013/0323661 | A1 | 12/2013 | Goodson et al. |
| 2013/0333279 | A1 | 12/2013 | Osler et al. |
| 2013/0336352 | A1 | 12/2013 | Colannino et al. |
| 2014/0051030 | A1 | 2/2014 | Colannino et al. |
| 2014/0065558 | A1 | 3/2014 | Colannino et al. |
| 2014/0076212 | A1 | 3/2014 | Goodson et al. |
| 2014/0080070 | A1 | 3/2014 | Krichtafovitch et al. |
| 2014/0162195 | A1 | 6/2014 | Lee et al. |
| 2014/0162196 | A1 | 6/2014 | Krichtafovitch et al. |
| 2014/0162197 | A1 | 6/2014 | Krichtafovitch et al. |
| 2014/0162198 | A1 | 6/2014 | Krichtafovitch et al. |
| 2014/0170569 | A1 | 6/2014 | Anderson et al. |
| 2014/0170571 | A1 | 6/2014 | Casasanta, III et al. |
| 2014/0170575 | A1 | 6/2014 | Krichtafovitch |
| 2014/0170576 | A1 | 6/2014 | Colannino et al. |
| 2014/0170577 | A1 | 6/2014 | Colannino et al. |
| 2014/0186778 | A1 | 7/2014 | Colannino et al. |
| 2014/0196368 | A1 | 7/2014 | Wiklof |
| 2014/0196369 | A1 | 7/2014 | Wiklof |
| 2014/0208758 | A1 | 7/2014 | Breidenthal et al. |
| 2014/0212820 | A1 | 7/2014 | Colannino et al. |
| 2014/0216401 | A1 | 8/2014 | Colannino et al. |
| 2014/0227645 | A1 | 8/2014 | Krichtafovitch et al. |
| 2014/0227646 | A1 | 8/2014 | Krichtafovitch et al. |
| 2014/0227649 | A1 | 8/2014 | Krichtafovitch et al. |
| 2014/0248566 | A1 | 9/2014 | Krichtafovitch et al. |
| 2014/0255856 | A1 | 9/2014 | Colannino et al. |
| 2014/0272731 | A1 | 9/2014 | Breidenthal et al. |
| 2014/0287368 | A1 | 9/2014 | Krichtafovitch et al. |
| 2014/0295094 | A1 | 10/2014 | Casasanta, III |
| 2014/0295360 | A1 | 10/2014 | Wiklof |
| 2014/0335460 | A1 | 11/2014 | Wiklof et al. |
| 2015/0079524 | A1 | 3/2015 | Colannino et al. |
| 2015/0104748 | A1 | 4/2015 | Dumas et al. |
| 2015/0107260 | A1 | 4/2015 | Colannino et al. |
| 2015/0118629 | A1 | 4/2015 | Colannino et al. |
| 2015/0121890 | A1 | 5/2015 | Colannino et al. |
| 2015/0140498 | A1 | 5/2015 | Colannino |
| 2015/0147704 | A1 | 5/2015 | Krichtafovitch et al. |
| 2015/0147705 | A1 | 5/2015 | Colannino et al. |
| 2015/0147706 | A1 | 5/2015 | Krichtafovitch et al. |
| 2015/0219333 | A1 | 8/2015 | Colannino et al. |
| 2015/0226424 | A1 | 8/2015 | Breidenthal et al. |
| 2015/0241057 | A1 | 8/2015 | Krichtafovitch et al. |
| 2015/0276211 | A1 | 10/2015 | Colannino et al. |
| 2015/0338089 | A1 | 11/2015 | Krichtafovitch et al. |
| 2015/0345780 | A1 | 12/2015 | Krichtafovitch |
| 2015/0345781 | A1 | 12/2015 | Krichtafovitch et al. |
| 2015/0362178 | A1 | 12/2015 | Karkow et al. |
| 2015/0369476 | A1 | 12/2015 | Wiklof |
| 2015/0369477 | A1 | 12/2015 | Karkow et al. |
| 2016/0033125 | A1 | 2/2016 | Krichtafovitch et al. |
| 2016/0040872 | A1 | 2/2016 | Colannino et al. |
| 2016/0047542 | A1 | 2/2016 | Wiklof et al. |
| 2016/0109118 | A1 | 4/2016 | Krichtafovitch et al. |
| 2016/0123576 | A1 | 5/2016 | Colannino et al. |
| 2016/0123577 | A1 | 5/2016 | Dumas et al. |
| 2016/0138799 | A1 | 5/2016 | Colannino et al. |
| 2016/0138800 | A1 | 5/2016 | Anderson et al. |
| 2016/0161110 | A1 | 6/2016 | Krichtafovitch et al. |
| 2016/0161115 | A1 | 6/2016 | Krichtafovitch et al. |
| 2016/0175851 | A1 | 6/2016 | Goodson |

FOREIGN PATENT DOCUMENTS

| | | |
|---|---|---|
| GB | 1042014 | 9/1966 |
| JP | S60216111 | 10/1985 |
| JP | 61-265404 | 11/1986 |
| JP | 2001/021110 | 1/2001 |
| WO | WO 96/01394 | 1/1996 |
| WO | WO 2013/181569 | 12/2013 |
| WO | WO 2015/042566 | 3/2015 |
| WO | WO 2015/051136 | 4/2015 |
| WO | WO 2015/051377 | 4/2015 |
| WO | WO 2015/057740 | 4/2015 |
| WO | WO 2015/089306 | 6/2015 |
| WO | WO 2015/103436 | 7/2015 |
| WO | WO 2016/003883 | 1/2016 |
| WO | WO 2016/018610 | 2/2016 |

* cited by examiner

DYNAMIC FLAME CONTROL

CROSS-REFERENCE TO RELATED APPLICATIONS

This application claims the benefit of U.S. Provisional Patent Application No. 61/773,093, entitled "DYNAMIC FLAME CONTROL", filed Mar. 5, 2013, which is incorporated herein by reference in its entirety.

BACKGROUND

Electric-field-based combustion control systems have been developed to use electric fields to manipulate the movement of electrically charged molecules (e.g., ions) of a charged flame. The flame is created by a combustion process and then electrically charged to generate the charged flame. The electric fields create electrostatic forces within the charged flame. The charged flame can be manipulated to control flame position, flame shape, heat transfer, and other flame characteristics. At the same time, the electric fields can help influence combustion chemistry to suppress formation of pollutants at flame sources.

Generally, these combustion control systems involve the use of one or more electrodes, such as tubular, planar, or post-type, fabricated from macroscopic metallic sheets, pipes, or rods. Dynamic control of a flame trajectory may be difficult and/or non-effective.

Therefore, developers and users of combustion control systems continue to develop technologies to improve combustion control systems and methods of manufacturing of combustion control systems.

SUMMARY

The present disclosure provides combustion systems, flame control systems, and methods for dynamically controlling flame position and/or shape. In an embodiment, a combustion system is disclosed. The combustion system includes a burner, a flame charging device, and a flame control system. The burner is configured to output a flow including fuel that when ignited generates a flame. The flame charging device is positioned adjacent to the flame and configured to charge the flame to generate a charged flame. The flame control system includes one or more electrodes disposed adjacent to the charged flame, a charge managing module operatively coupled to the one or more electrodes, one or more sensors in electrical communication to the controller, and a controller in electrical communication with the charge managing module and the one or more sensors. The charge managing module is configured to control charging and discharging of the one or more electrodes. The one or more sensors are positioned and configured to measure at least one combustion parameter of the charged flame. The controller is configured to control operation of the charge managing module responsive to the at least one combustion parameter being measured by the one or more sensors.

In an embodiment, a method for adjusting the position and/or shape of a flame in a combustion system is disclosed. The method includes charging a flame to generate a charged flame, disposing one or more electrodes adjacent to the charged flame, determining a position and/or a shape of the charged flame, and responsive to the determined position and/or shape, delivering bursts of electrical energy to the one or more electrodes to dynamically adjust the position and/or the shape of the charged flame toward a predetermined position and/or shape.

In an embodiment, a flame control system is disclosed. The flame control system includes one or more electrodes configured to be disposed adjacent to a charged flame, and a charge managing module including an electrical energy device coupled to a pulse transformer that is operatively coupled to the one or more electrodes. The charge managing module is configured to control charging and discharging of the one or more electrodes. The flame control system includes one or more sensors in electrical communication with the controller. The one or more sensors are positioned and configured to measure at least one combustion parameter of the charged flame. The flame control system additionally includes a controller in electrical communication with the charge managing module and the one or more sensors. The controller is programmed to control the pulse transformer to deliver energy to the one or more electrodes responsive to the one or more sensors measuring the at least one combustion parameter of the charged flame.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The description will be more fully understood with reference to the following figures and data graphs, which are presented as various embodiments of the disclosure and should not be construed as a complete recitation of the scope of the disclosure. Non-limiting embodiments of the present disclosure are described by way of example with reference to the accompanying figures which are schematic and are not intended to be drawn to scale.

DETAILED DESCRIPTION

Figure 1:
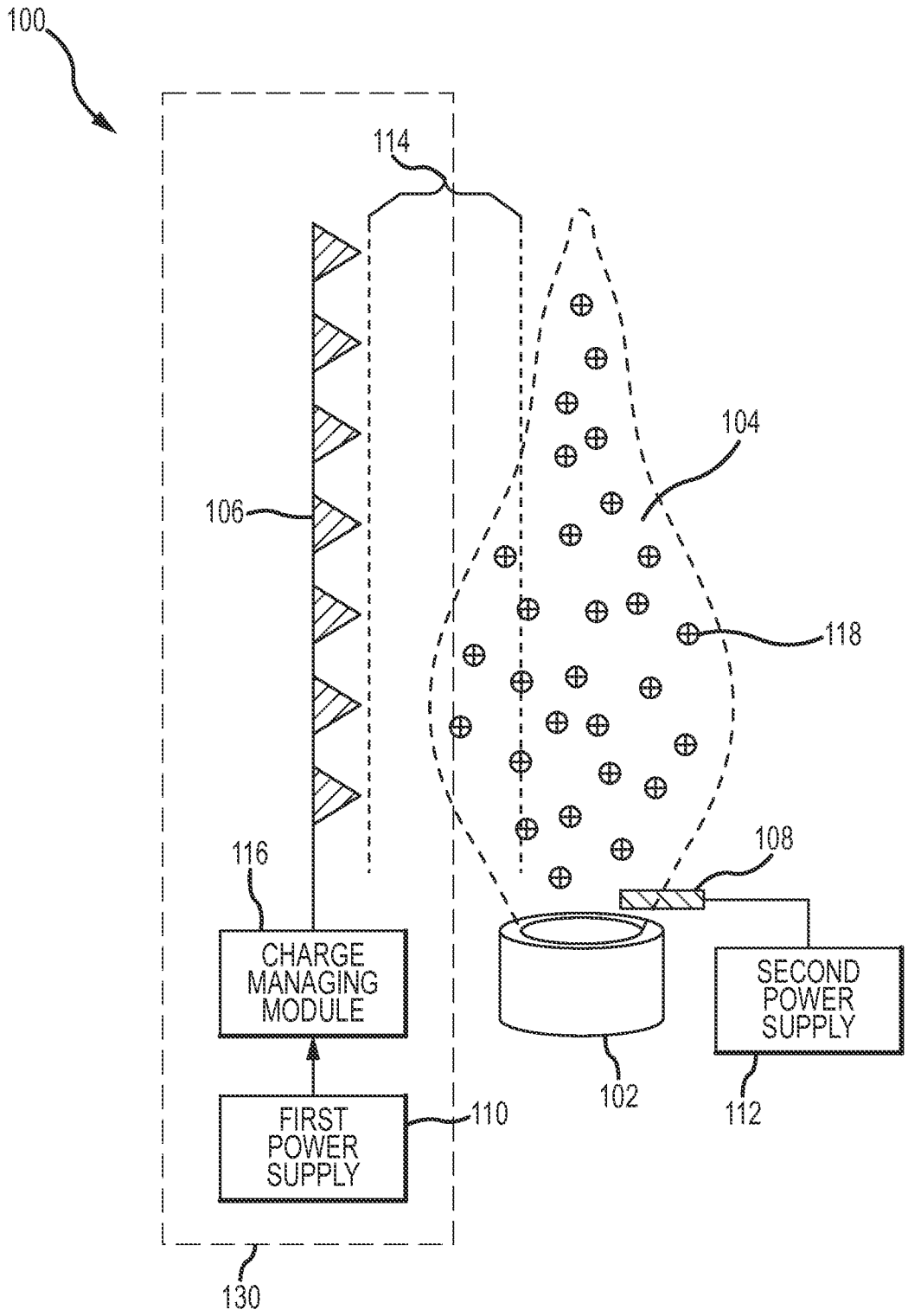
FIG. 1 is a simplified view of a combustion system including a dynamic flame control system according to an embodiment.

The present disclosure may be understood by reference to the following detailed description, taken in conjunction with the drawings as described below. It is noted that, for purposes of illustrative clarity, certain elements in various drawings may not be drawn to scale. The illustrative embodiments described in the detailed description, drawings and claims, are not meant to be limiting. Other embodiments may be used and/or and other changes may be made without departing from the spirit or scope of the present disclosure.

Embodiments disclosed herein provide a combustion system including a flame control system for repelling or attracting a flame to certain areas, which may be referred to as flame trajectory. The flame control system includes one or more electrodes configured to apply one or more of a voltage, a charge, or an electric field for repelling or attracting a charged flame to a certain area or an object. The combustion system may also include feedback systems configured to determine a shape and/or a position of the charged flame within a combustion volume. For example, the flame control system may include one or more sensors configured to measure combustion parameters. The flame control system may also include a control module, such as a programmable controller, configured to determine flame position and/or flame shape based upon the measured combustion parameters. The flame control system may adjust the flame position and/or shape to a target position and/or a target shape responsive to the measured combustion parameters.

The flame control system may also include a charge managing module, which may control charge and discharge of electrodes for delivering rapid bursts of electrical energy to the charged flame. The charge managing module may include a capacitor for storing electrical energy, and a pulse transformer configured to amplify the voltage discharged from the capacitor. The charge managing module may also include a metal-oxide semiconductor field effect transistor (MOSFET) configured to control fast electrical energy delivery to the charged flame to adjust the flame position and/or shape through the one or more electrodes.

The present disclosure also provides apparatus and methods for generating charged flame. The flame is typically produced by igniting a flow stream entering the combustion volume, for example, by a burner. The flow stream may include one or more of (a) a fuel stream, (b) a process gas stream (e.g. a gas including $H_2$ and CO), a fuel stream, and adjacent air, (c) a fuel stream and adjacent flue gas, or (d) a premixed fuel and oxidizer mixture. For example, the flow stream may include a hydrocarbon gas and ambient air. Once the flame is generated, the flamed is charged by various means.

Dynamic control of a flame trajectory may provide several benefits such as one or more of improved air/fuel mixing, flame stability, reduction of pollutants (e.g., nitrogen oxide ($NO_x$) and carbon monoxide (CO)), or higher reliability of equipment, among others. Specifically, by increasing mixing of fuel and oxidizer, $NO_x$ and CO may be reduced, flame stability may be improved, flame emissivity may be enhanced, or combinations thereof.

According to various embodiments, flame position control may be suitable for a large variety of fuels including gas fuels, liquid fuels, and solid fuels, in different combustion applications. For example, it may be desirable to control flame trajectory in combustion volume objects, such as ethylene crackers, steam methane reformers, and other heaters, reactors and furnaces, which may be used in oil and chemical processing applications. The combustion volume objects include pipes or walls, steam pipes, and reactor walls. Carbon accumulation may occur inside reactor tubes during a combustion process. The carbon accumulation may negatively affect mean-time-between-failure (MTBF) of the reactor tubes. By controlling the flame trajectory, the MTBF may be increased by avoiding the carbon accumulation and thus the reliability of the equipment is improved. For example, by increasing mixing of fuel and oxidizer, CO may be reduced, and flame stability may be improved, or flame emissivity may be enhanced.

FIG. 1 is a simplified view of a combustion system 100 including a dynamic flame control system according to an embodiment. The combustion system 100 may include a burner 102 configured to generate a flame 104. For example, the burner 102 may include a nozzle that outputs a flow of fuel or a mixture of fuel and an oxidizer (e.g., air) that is ignited to generate the flame 104. The burner 102 is positioned near the base region of the flame 104. The combustion system 100 may also include a flame charging device 108 configured to charge the flame 104. The flame charging device 108 may include at least one of an electrode, a laser beam projector, an ion generator, a corona discharge electrode, or other suitable device to generate a majority charge in the flame 104. The flame 104 may be electrically charged to increase its voltage potential and, thereby, to increase the response of the flame to one or more of a voltage, a charge, or an electric field applied proximate to the flame 104. The flame 104 may exhibit a positive or negative charge as the result of a majority of positively or negatively charged species 118.

The flame charging device 108 may be powered by a power supply 112. In some embodiments, the flame charging device 108 may be fed by a DC power source. Thus, the power supply 112 may provide a constant charge or voltage potential to the flame charging device 108. In addition, the flame charging device 108 may be located in different locations within the combustion system 100 than illustrated. For example, the flame charging device 108 may or may not contact the flame 104.

The combustion system 100 may also include a flame control system 130 configured to determine flame position and/or flame shape and/or dimension, followed by changing or modifying the position and/or shape of the charged flame 104. The flame control system 130 includes one or more electrodes 106 configured to dynamically control a position and/or a shape of the charged flame 104 through the application of one or more of an electrical charge, a voltage potential, or an electric field to the charged flame 104. For example, any of the electrodes disclosed herein may include an electrically conducting material configured for the application of one or more of an electric charge, a voltage potential, or an electric field to a flame. Specifically, the one or more electrodes 106 apply one or more of a charge, a voltage, or an electric field to the charged flame 104. The voltage, charge or electric fields generated by the one or more electrodes 106 may repel or attract the charged flame 104 to a certain area or object depending on the relative polarity of the charged flame 104 and the one or more electrodes 106.

The electrodes 106 may be located in different regions adjacent to the charged flame 104 and may also exhibit various shapes, quantities, and sizes or dimensions according to flame locations. Voltage, charge, and electric fields may be applied with various waveforms and voltages/current intensities, according to a flame trajectory. The one or more electrodes may have a substantially planar shape, a tubular shape, or the like. It will be appreciated that the electrodes may vary in shape, size, and quantity, as well as positions relative to the charged flame 104.

The flame control system 130 may include a power source or supply 110 operatively coupled to the electrodes 106. The power supply 110 may supply a voltage to the electrodes 106. The flame control system 130 may also include a charge managing module 116 operatively coupled to the electrodes 106 and the power supply 110. The charge managing module 116 controls charge and discharge of the electrodes 106. The charge managing module 116 provides positive or negative charge to the one or more electrodes 106, depending upon the need to repel or to attract the charged flame 104. For example, according to Coulomb's Law of charge repulsion, if the charged flame 104 needs to be repelled from a specific region, such as the walls of a steam methane reformer, then the electrodes 106 may be positioned in that specific region and may be charged with the same polarity of the charged flame 104. Conversely, if the charged flame 104 needs to be attracted to a certain region that includes the electrodes 106, then the electrodes 106 may be charged with an opposite polarity of the charged flame 104. As such, the electrodes 106 may be placed in different regions or objects and may be positively or negatively charged to repel or attract the charged flame 104.

The charge managing module 116 may include energy storage devices, which may store energy in the form of electric energy and/or magnetic energy and may include capacitors, inductors, batteries, and the like. In some embodiments, the energy storage devices may be capacitors, which store electrical energy provided from a direct current (DC) power supply 110. In other embodiments, the energy storage devices may be inductors, which store magnetic energy provided from an alternating current (AC) power supply 110. In some embodiments, the power supply 110 and the power supply 112 may be combined into a single power supply.

Furthermore, flame trajectory and/or flame position may be detected within a flame detection area 114, when the charged flame 104 may be approaching or moving away from the flame detection area 114. In an embodiment, the flame carries a majority charge that may be detected by an adjacent or immersed electrode. The presence or absence of the majority charge may be used to determine whether the flame is in a predetermined or sensed position (along the flame trajectory). In an embodiment, a relative concentration of sensed charge provides feedback related to flame temperature, flame mixture, flame stability, other flame characteristic(s), or combinations thereof.

Figure 2:
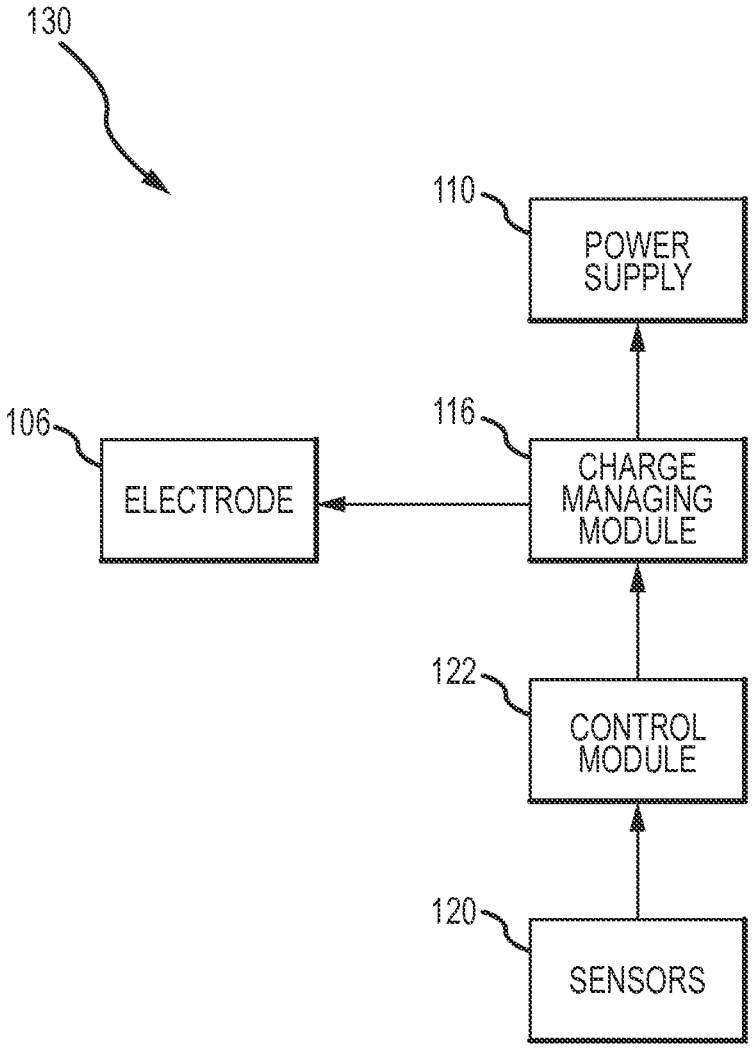
FIG. 2 is a block diagram of a detailed flame control system of FIG. 1 according to an embodiment.

FIG. 2 is a more detailed block diagram of the flame control system 130 of FIG. 1 according to an embodiment. As shown, the flame control system 130 may incorporate one or more sensors 120 for measuring a variety of combustion parameters. The one or more sensors 120 measure one or more combustion parameters (e.g., temperature, opacity, and the like) of flame 104 to determine position of the flame 104 within flame detection area 114 between the electrodes 106 and the flame 104. The sensors 120 may include thermal sensors, electric sensors, optical sensors, the like, or combinations thereof. Additionally, the sensors 120 may be configured to measure combustion parameters, such as a fuel particle flow rate, stack gas temperature, stack gas optical density, combustion volume temperature and pressure, luminosity, level of acoustics, combustion volume ionization, ionization near one or more electrodes 106, combustion volume maintenance lockout, electrical fault, or combinations thereof.

As shown in FIG. 2, the flame control system 130 may also include a control module 122, such as a programmable controller, computer, CPU, and the like. The control module 208 may analyze the measured combustion parameters received from the sensors 120 to determine the flame position. The control module 122 of the flame control system 130 may subsequently modify the flame position by controlling and directing the release of energy from the charge managing module 116 to the electrodes 106 positioned proximate to the charged flame 104. Specifically, the control module 122 may communicate with the charge managing module 116 to control a trajectory past the flame detection area 114, based upon the detected position of the charged flame 104. The electrodes 106 coupled to the charge managing module 116 may respond to the detected position of charged flame 104 with a specific electric charge to repel or to attract charged flame 104 to or from the flame detection area 114. In some embodiments, the power supply 112 may be coupled to the control module 122 in addition to the power supply 110, and the power supply 112 may also be controlled by the control module 122.

Figure 3:
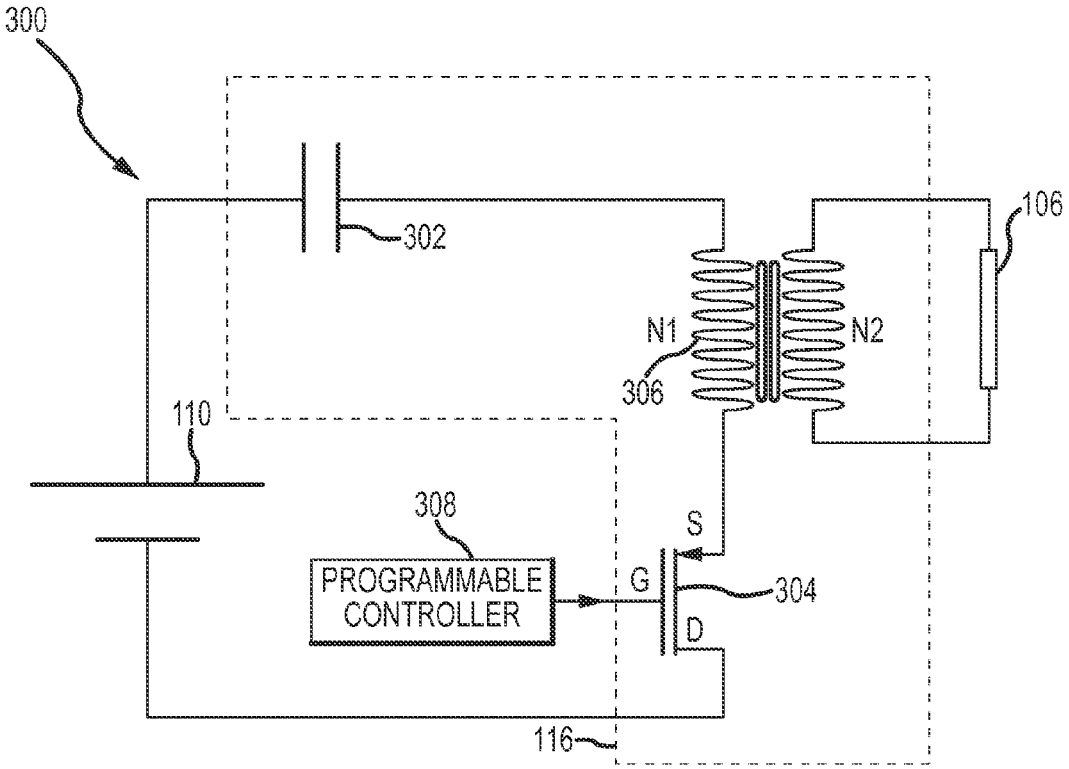
FIG. 3 is a circuit diagram of the dynamic flame control system according to an embodiment.

FIG. 3 depicts a circuit diagram of the dynamic flame control system 130 according to an embodiment. The circuit diagram 300 includes a charge managing module 116 operatively coupled to a programmable controller 308 which communicates with the sensors 120 (not shown). The charge managing module 116 is connected to a DC power supply 110.

The charge managing module 116 may further include one or more energy storage devices that may storage energy from a conventional power supply. For example, the charge managing module 116 may include a capacitor 302 as an electrical energy storage device, a pulse transformer 306, and a switch 304 (e.g., a MOSFET transistor) as a switching device. For example, the electrical energy storage device including at least one circuit element that may store electrical energy or magnetic energy, the pulse transformer may be a voltage transformer that may deliver rapid bursts of electrical energy to one or more electrodes, and a MOSFET transistor may be a solid-state diode or "switch" used to open and close an analog circuit or a digital circuit. The circuit diagram 300 may operate and allow rapidly switching charging and discharging of capacitor 302. It should be noted that other energy storage devices may be used, such as inductors, battery and the like.

The switch 304 (e.g. MOSFT transistor) may be configured to control the release of stored energy from electrical energy storage device 302 to a pulse transformer 306, which may convert low voltage to high voltage. The pulse transformer 306 may be operatively coupled with the switch device 304 for delivering electrical energy to the electrodes 106. The pulse transformer 306 allows the use of a conventional power supply for delivering rapid bursts of electrical energy to a charged flame through the electrodes 106. The pulse transformer 306 may energize electrodes 106 for applying a high voltage potential to the charged flame 104 during short periods of time. The pulse transformer 306 allows the power supply 110 to have relatively lower power requirements, and avoids use of a relatively larger and more expensive high voltage power supply ("HVPS"). As a result, less power consumption may be required for controlling a flame position. In other embodiments, one or more pulse transformers 306 may be configured in series or in parallel according to power requirements of a specific application.

In operation, the capacitor 302 may be charged by the power supply 110 with a voltage, for example, about 100 Volts. The programmable controller 308 may send a signal to the MOSFET transistor 304 for switching the MOSFET transistor 304 to a closed position, and the capacitor 302 may release electrical stored energy to the pulse transformer 306 which may amplify the voltage of about 100 Volts from the power supply 110 to a significantly higher voltage ranging between about 5 KV and about 80 KV. This amplified voltage may be applied to the electrodes 106. The programmable controller 308 may also send a signal to the MOSFET transistor 304 for switching to an open position, to stop energizing the electrodes 106. Rapidly switching the MOSFET transistor 304 may allow for rapidly charging and discharging the electrodes 106, which enables modification of flame position through the application of rapid bursts of electrical energy. It will be appreciated that switching operation in charge managing module 116 may be performed by a variety of devices such as power relays, power switches, and the like.

Figure 4:
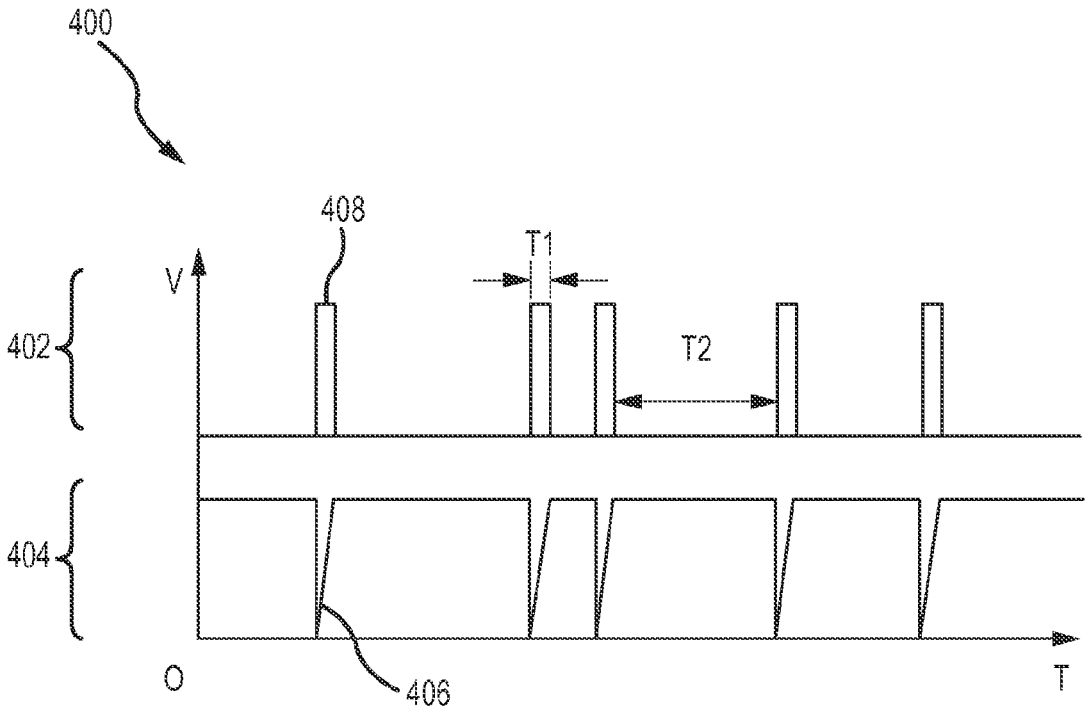
FIG. 4 shows waveforms depicting the operation of charging and discharging the energy storage device of FIG. 3 according to an embodiment.

FIG. 4 depicts voltage waveforms 400 that charge and discharge electrical energy storage devices in charge managing module 116 according to one or more embodiments. Electrical energy storage devices, such as the capacitor 302, may be charged by the power supply 110, when the MOSFET transistor 304 is in an open position. Square voltage pulses 408 in waveform 402 represent electrical energy stored in capacitor 302.

When the MOSFET transistor 304 is switched to a closed position, electrical energy stored in capacitor 302 may be released to the pulse transformer 306. Specifically, voltage pulses 408 in waveform 402 as shown in FIG. 3 may be discharged to pulse transformer 306 to be amplified and then delivered to the charged flame 104 as a rapid burst of electrical energy. Voltage decays 406 in waveform 404 as shown in FIG. 3 represent released electrical energy to the pulse transformer 306 corresponding to the stored voltage pulse 408 in waveform 402. Waveforms 400 may continue for delivering one or more rapid bursts of electrical energy to charged flame 104 according to the flame position.

Flame position modification may be achieved when the charged flame 104 reacts to rapid bursts of electrical energy delivered by the electrodes 106. The burst of electrical energy may be represented by waveform 404. This rapid delivery of electrical energy may occur in enough time for inducing a response in the charged flame 104. Specifically, each of the bursts is delivered in a period of time ($T_1$ as shown in FIG. 4) ranging from about 0.1 millisecond (ms) to about 1 ms, and may be rapidly repeated as required for dynamic control of flame position or shape. The time between two bursts ($T_2$, as shown in FIG. 4) may vary.

Figure 5:
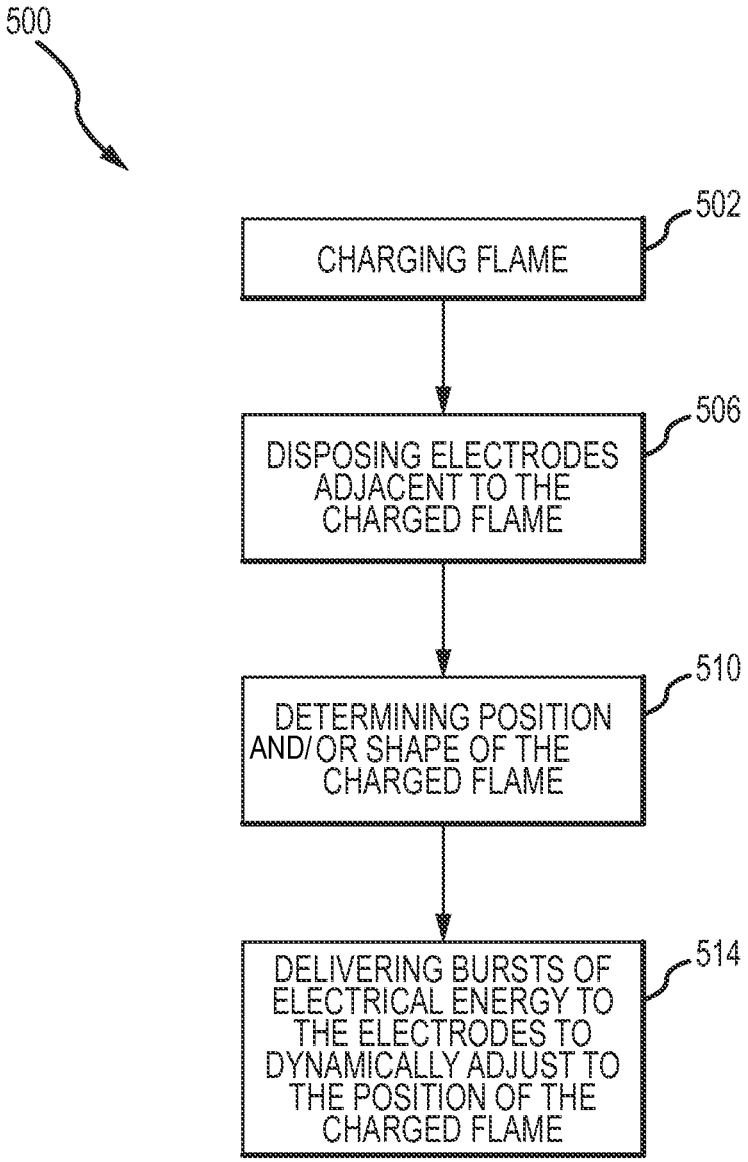
FIG. 5 is a flow chart illustrating methods for monitoring and modifying flame position according to an embodiment.

FIG. 5 is a flow chart illustrating a method 500 for monitoring and modifying flame position and/or shape according to an embodiment. The method 500 includes charging flame for dynamically controlling the position and/or shape of a flame at operation 502. For example, a majority amount of positively or negatively charged species 118 may be introduced into the flame 104 by the charging device 108 to increase the electrical response of flame 104, as described with respect to FIG. 1. The method 500 also includes disposing one or more electrodes adjacent to the charged flame at operation 506. For example, the electrodes 106 modify the flame position and/or shape of the flame 104.

The method 500 further includes determining a position and/or a shape of the charged flame at operation 510. For example, the control module 122 (FIG. 2) determines the position and/or shape of the charged flame based upon the combustion parameters measured by sensors 120.

The method 500 also includes delivering bursts of electrical energy to the one or more electrodes to dynamically adjust the position and/or the shape of the charged flame toward a predetermined position or shape at operation 514. For example, the electrodes 106 deliver the bursts of electrical energy to the charged flame 104 to modify the flame position or shape.

While various aspects and embodiments have been disclosed, other aspects and embodiments may be contemplated. The various aspects and embodiments disclosed here are for purposes of illustration and are not intended to be limiting, with the true scope and spirit being indicated by the following claims.

What is claimed is:

1. A flame control system, comprising:

one or more electrodes configured to be disposed adjacent to a charged flame;

a charge managing module including an electrical energy device coupled to a pulse transformer that is coupled to the one or more electrodes, the charge managing module further including a switch having a field effect transistor (FET), the charge managing module configured to control charging and discharging of the one or more electrodes;

one or more sensors in electrical communication with the controller, the one or more sensors positioned and configured to measure at least one combustion parameter of the charged flame; and a controller in electrical communication with the charge managing module and the one or more sensors, the controller programmed to control the pulse transformer to deliver energy to the one or more electrodes responsive to the one or more sensors measuring the at least one combustion parameter of the charged flame.

2. The flame control system of claim 1, wherein the one or more electrodes are configured to deliver bursts of electrical energy in a period of time ranging from about 0.1 millisecond to about 1 millisecond to the charged flame.

3. The flame control system of claim 1, wherein the charge managing module includes an energy storage device having at least one of a capacitor, an inductor, or a battery.

4. The flame control system of claim 3, wherein the switch is configured to control release of stored energy from the energy storage device to the pulse transformer.

5. The flame control system of claim 1, wherein the FET includes a metal-oxide semiconductor field effect transistor.

* * * * *